United States Patent [19]

Picone

[11] Patent Number: 4,512,221

[45] Date of Patent: Apr. 23, 1985

[54] ELECTRIC POWERED ADJUSTABLE WRENCH

[76] Inventor: John A. Picone, 195 Quebec Rd., Island Park, N.Y. 11558

[21] Appl. No.: 526,202

[22] Filed: Aug. 25, 1983

[51] Int. Cl.[3] ..... B25B 13/16

[52] U.S. Cl. ..... 81/170; 81/165

[58] Field of Search ..... 81/54, 57.21, 155, 165, 81/170; 269/225, 240, 244

[56] References Cited

U.S. PATENT DOCUMENTS 2,615,682 10/1952 Stone ..... 81/57.21

3,613,983 10/1971 Gage et al. ..... 269/244 X

FOREIGN PATENT DOCUMENTS 927015 3/1946 France ..... 81/155

*Primary Examiner*—James G. Smith

*Attorney, Agent, or Firm*—Wells & Wells

[57] ABSTRACT

An adjustable jaw end wrench, in which the adjustable jaw is operated by a worm gear, the worm gear is meshed with the rack of the movable jaw and the worm gear is driven by an electric motor. Linear motion propelling the jaw open and/or closed is produced by the electric motor. Batteries in the handle provide the power for the electric movement and a DPDT (Double Pole Double Throw) switch controls the function of the wrench.

5 Claims, 8 Drawing Figures

ELECTRIC POWERED ADJUSTABLE WRENCH

BACKGROUND OF THE INVENTION

The field of the invention is tools and the present invention is particularly concerned with wrenches having a sliding side jaw.

The state of the art of adjustable wrenches may be ascertained by reference to U.S. Pat. Nos. 3,640,159; 3,673,896; 3,901,107; 4,028,970; and 4,375,174, the disclosures of which are incorporated herein by reference.

U.S. Pat. Nos. 3,901,107 and 4,028,970, are the most pertinent references to the present invention because they show adjustable jaw open end wrenches having thumb operated pulleys and driving belts for adjusting the jaws.

Conditions arise in the use of the prior art adjustable wrenches wherein it is impossible or cumbersome to manually adjust the sliding jaw. This can happen when it is necessary to remove the wrench from the work for adjustment. Also, it is diffiucult to adjust the prior art wrenches when the fingers are restricted by gloves or impaired by joint disease.

SUMMARY OF THE INVENTION

Having in mind the limitations of the prior art is an object of the present invention to provide an adjustable wrench which can be opened and closed to any desired setting by actuation of a switch.

This object is achieved by an adjustable jaw end wrench in which the adjustable jaw is operated by a worm gear meshed with a rack of a movable jaw and the worm gear is driven by an electric motor. Batteries in the handle provide power for the electric movement and a DPDT (double pole double throw) switch controls the function of the wrench.

BRIEF DESCRIPTION OF THE DRAWINGS

Embodiments of the electric powered adjustable wrench of the present invention are shown in the appended drawings, wherein.

DESCRIPTION OF THE PREFERRED EMBODIMENTS

Figure 1:
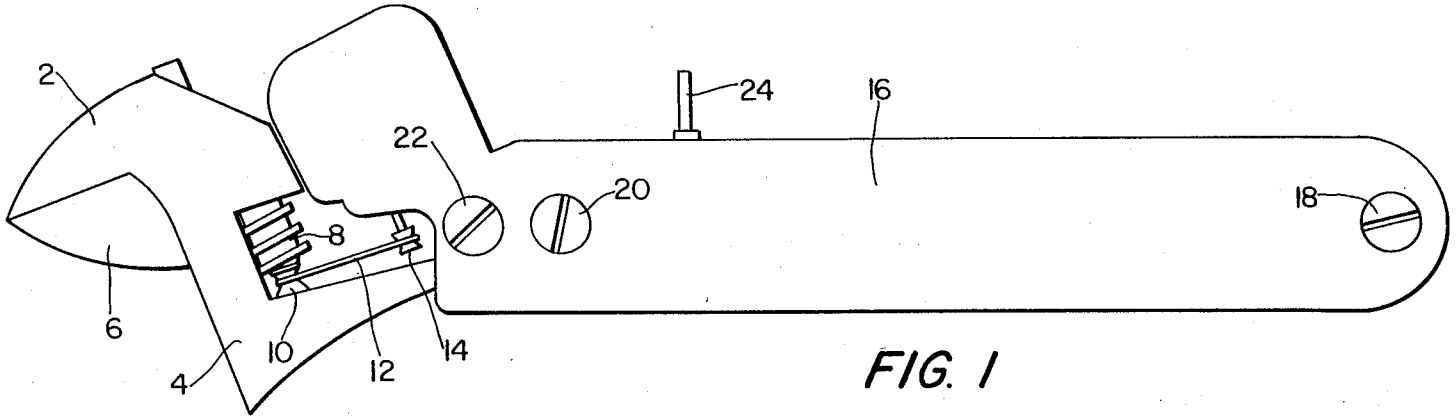
FIG. 1 is an elevational plan view of the electric powered adjustable wrench of the present invention with the handle housing in place.

The invention is best described by reference to the drawings, particularly FIG. 1.

Fixed jaw 2 is integral with the wrench head 4 and jaw 6 is adjustable relative to the fixed jaw. Modified worm gear 8 having a pulley 10 is rotated by belt 12 and motor pulley 14.

Upper handle housing 16 is held in place by head bolts 18, 20, and 22. Double pole double throw switch 24 is used to control the opening and closing of adjustable jaw 6.

Figure 2:
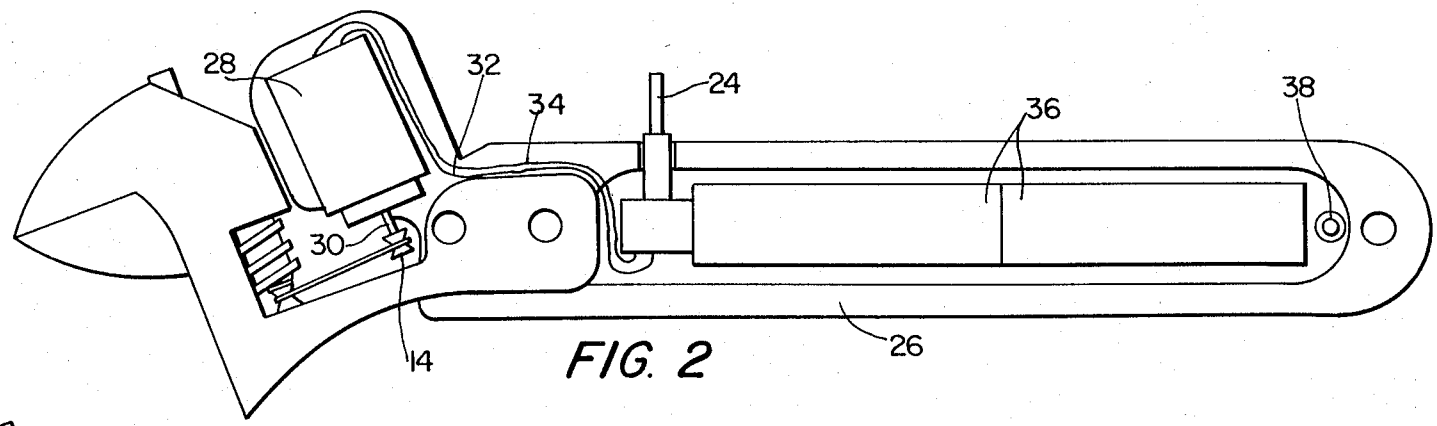
FIG. 2 is an elevational plan view as in FIG. 1 with the upper handle housing removed.

FIG. 2, with the upper handle housing 16 removed, reveals bottom handle housing 26 with electric motor 28 connected to motor pulley 14 by shaft 30. Wires 32 and 34 connect motor 28 with DPDT switch 24 and batteries 36 supply power for the switch and motor. A sub mini jack 38 is used for recharging the batteries 36.

Figure 3:
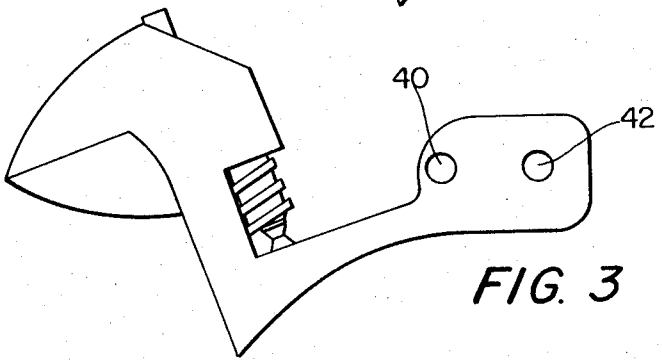
FIG. 3 is an elevational plan view of the wrench head of the present invention.

FIG. 3 shows the wrench head 4 removed from the handles with holes 40 and 42 for holding the head to the handles by head bolts 20 and 22.

Figure 5:
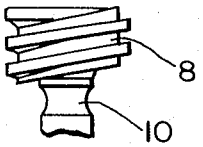
FIG. 5 is a detailed showing of the modified worm gear and driven pulley used in FIGS. 1, 2, and 3.
Figure 4:
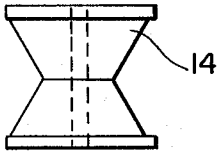
FIG. 4 is a detailed showing of the motor pulley used in FIGS. 1 and 2.

Motor pulley 14 is shown in detail in FIG. 4 while modified worm gear 8 and pulley 10, integral therewith, are shown in FIG. 5.

Figure 6:
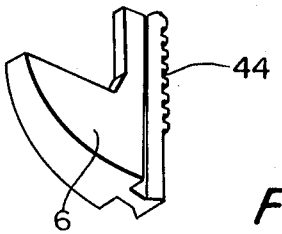
FIG. 6 is a detailed showing of the adjustble jaw and rack used in FIGS. 1, 2, and 3.

FIG. 6 shows adjustable jaw 6 with rack 44 for engagement with modified worm gear 8.

Figure 7:
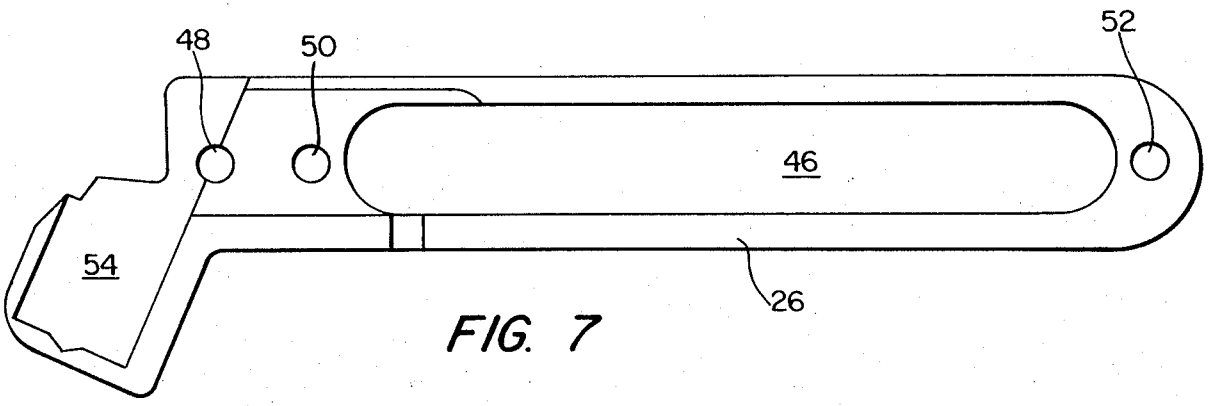
FIG. 7 is a plan view of the upper handle housing of FIG. 1.

Upper handle housing 16 is shown in FIG. 7 with battery recess 46 and holes 48, 50, and 52, for securing the wrench head and lower housing together by head bolts 18, 20, and 22. Motor 28 is contained in motor recess 54.

Figure 8:
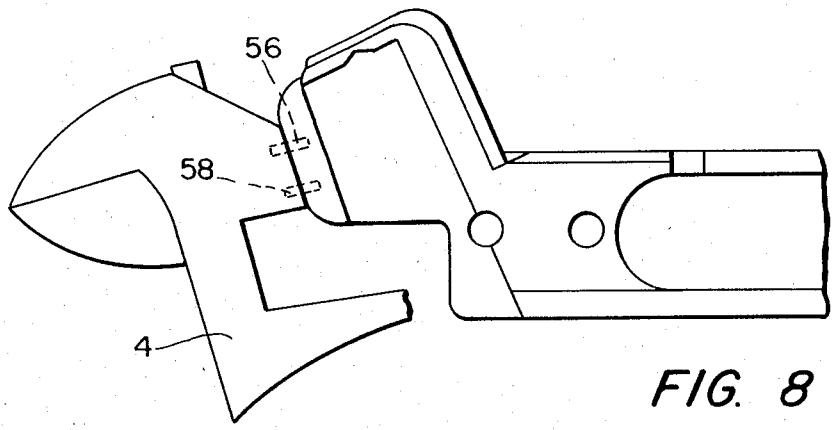
FIG. 8 is a plan view of the lower handle housing of FIG. 1 with the wrench head pinned into the handle housing.

FIG. 8 shows an embodiment of lower handle housing 26 secured to wrench head 4 by pins 56 and 58.

BEST MODE OF CARRYING OUT THE INVENTION

Motor 28 is suitably a permanent magnet motor of 1.5–6.0 volts d.c. 3,300 RPM designated 273-208 by Realistic Radio Shack.

Water proofing rubber gaskets can be used in the handle housing as necessary to prevent moisture from entering and a water proof seal such as TEFLON can be used to protect the motor from water entering therein.

Drive belt 12 can be of the non-slip V type.

The electric powered adjustable wrench of the present invention is used in place of a conventional manually operated adjustable wrench as when conditions prove impossible or are too cumbersome, which impairs the use of fingers by gloves or any other handicaps thereof, or when work is performed in areas where estimated adjusting and sizing are necessary, the present invention has its greatest advantage. Tight areas where hands cannot be permitted and adjustment is done off the work and repeatedly adjusted for proper fit is the ideal application of the present invention. This wrench eliminates fuss and guess work as the jaw automatically adjusts itself on the work with the flick of the switch located on the handle of the wrench.

What I claim is:

1. In an adjustable jaw wrench comprising:

body means, said body means including an integral handle and a head portion, said head portion defining a stationary jaw;

a movable jaw reciprocally mounted in said body means, head portion in alignment with said stationary jaw, said movable jaw including a rack;

driven means mounted in said body means head portion, said driven means being operably connected to said movable jaw and causing movement of said movable jaw relative to said stationary jaw, and driven means including:

a worm gear rotatably mounted in said body means head, said worm gear engaging said movable jaw rack; and a first pulley integral with said worm gear, said first pulley being rotatable with said worm gear, said first pulley and at least a portion of said worm gear being positioned in an aperture in said body means head portion whereby said first pulley is accessible from opposite sides of said body means;

drive means mounted in said body means handle, said drive means comprising:

a second pulley rotatably mounted in said handle; and an endless drive belt, said drive belt extending between said first and second pulleys, the improvement comprising:

a reversible electric motor mounted in said body means handle in driving connection with said second pulley.

2. The adjustable jaw wrench of claim 1, wherein said reversible electric motor is electrically connected to a double pole double throw switch located in said body means handle for moving said movable jaw forward and backward.

3. The adjustable jaw wrench of claim 2, wherein said handle housing is adapted to hold electric batteries connected to said motor and switch for supplying power.

4. The adjustable jaw wrench of claim 3, wherein said handle housing has an upper portion and a lower portion.

5. The adjustable jaw wrench of claim 4, wherein said upper and lower portions of said handle housing are secured by head bolts passing through holes in said portions and said wrench head.

* * * * *